US007383680B2

(12) United States Patent
Odendall

(10) Patent No.: US 7,383,680 B2
(45) Date of Patent: Jun. 10, 2008

(54) METHOD FOR CONTROLLING THE LEAN OPERATION OF AN INTERNAL COMBUSTION ENGINE, ESPECIALLY AN INTERNAL COMBUSTION ENGINE OF A MOTOR VEHICLE, PROVIDED WITH A NOX STORAGE CATALYST

(75) Inventor: Bodo Odendall, Neuburg (DE)

(73) Assignee: Audi AG, Ingolstadt (DE)

( * ) Notice: Subject to any disclaimer, the term of this patent is extended or adjusted under 35 U.S.C. 154(b) by 329 days.

(21) Appl. No.: 10/526,983

(22) PCT Filed: Sep. 5, 2003

(86) PCT No.: PCT/EP03/09847

§ 371 (c)(1),
(2), (4) Date: Aug. 26, 2005

(87) PCT Pub. No.: WO2004/022953

PCT Pub. Date: Mar. 18, 2004

(65) Prior Publication Data

US 2006/0090454 A1 May 4, 2006

(30) Foreign Application Priority Data

Sep. 7, 2002 (DE) ..... 102 41 497

(51) Int. Cl.
*F01N 3/00* (2006.01)

(52) U.S. Cl. ..... 60/285; 60/286; 60/287; 60/295

(58) Field of Classification Search ..... 60/285, 60/286, 287, 295
See application file for complete search history.

(56) References Cited

U.S. PATENT DOCUMENTS 5,778,666 A * 7/1998 Cullen et al. ..... 60/274
6,263,666 B1 * 7/2001 Kubo et al. ..... 60/277

(Continued)

FOREIGN PATENT DOCUMENTS

DE 198 50 786 2/2000

(Continued)

*Primary Examiner*—Thomas Denion
(74) *Attorney, Agent, or Firm*—Novak Druce + Quigg LLP

(57) ABSTRACT

The invention relates to a method for controlling the lean operation of an internal combustion engine, especially an internal combustion engine of a motor vehicle, provided with a nitrogen oxide storage catalyst. As claimed in the invention, in a first process step, to establish the instant of switching from the storage phase to the discharge phase, a switching operating point is determined at least from the integral value of the nitrogen oxide mass flow upstream and/or downstream of the storage catalyst. The respective switching operating point is compared in a second process step to a definable operating field which is optimized especially with respect to the fuel savings potential as a function of the load acceptance of the internal combustion engine, which is formed by a plurality of individual operating points for one new and one aged storage catalyst, for a switching operating point which is located within the operating field the engine control enabling lean operation and thus switching between the storage phase and the discharge phase of the nitrogen oxide storage catalyst, while the engine control dictates lambda operation of the internal combustion engine at which lambda is equal to 1 for a switching operating point which departs from the definable operating field.

10 Claims, 4 Drawing Sheets

U.S. PATENT DOCUMENTS

| | | | | |
|---|---|---|---|---|
| 6,487,849 | B1 * | 12/2002 | Bidner et al. | 60/274 |
| 6,490,856 | B2 * | 12/2002 | Bidner et al. | 60/274 |
| 6,694,724 | B2 * | 2/2004 | Tanaka et al. | 60/274 |
| 7,194,854 | B2 * | 3/2007 | Surnilla et al. | 60/285 |
| 2005/0204724 | A1 * | 9/2005 | Hoard et al. | 60/275 |

FOREIGN PATENT DOCUMENTS

| | | |
|---|---|---|
| DE | WO 02/14658 | 2/2002 |
| DE | 100 51 012 | 4/2002 |
| JP | 1 087 119 | 3/2001 |

* cited by examiner

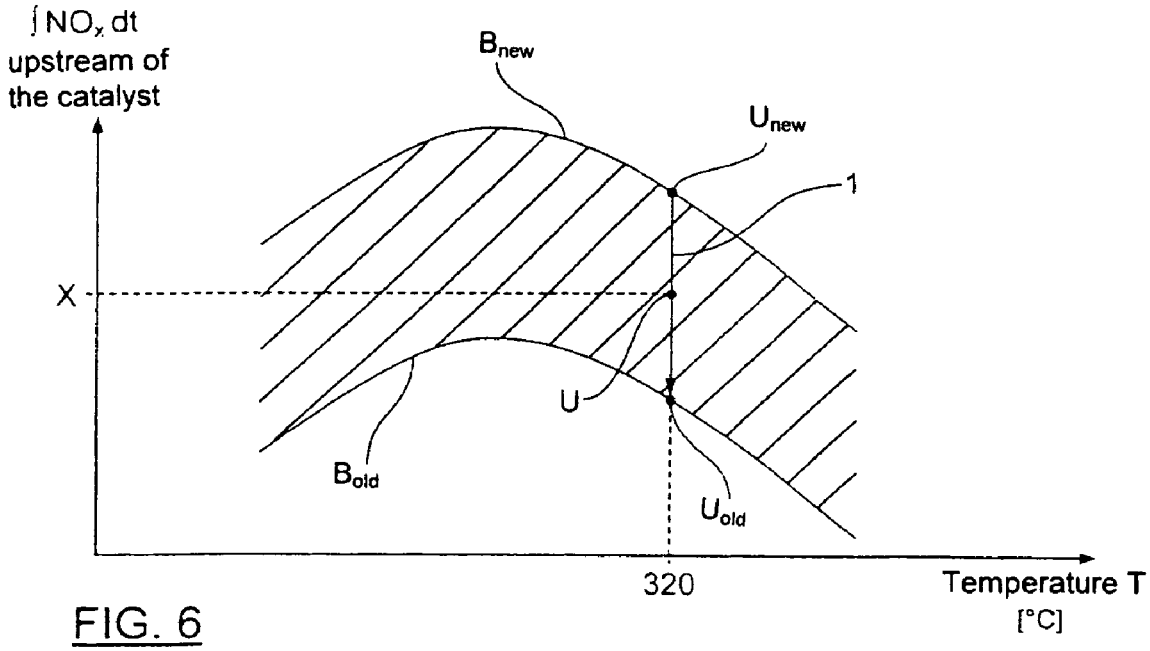
FIG. 6
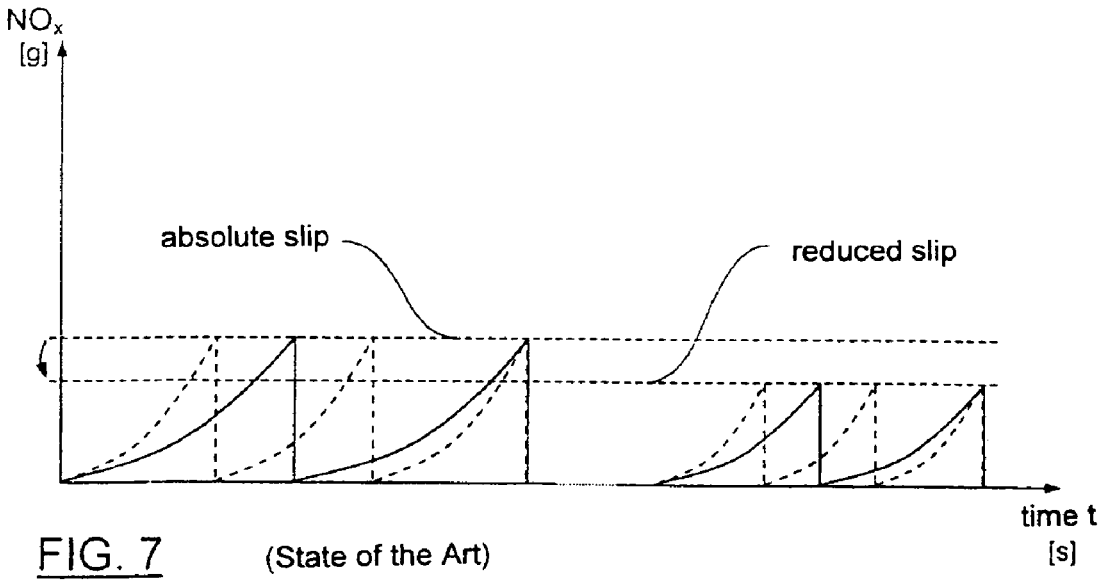
FIG. 7 (State of the Art)

METHOD FOR CONTROLLING THE LEAN OPERATION OF AN INTERNAL COMBUSTION ENGINE, ESPECIALLY AN INTERNAL COMBUSTION ENGINE OF A MOTOR VEHICLE, PROVIDED WITH A NOX STORAGE CATALYST

BACKGROUND

The invention relates to a method for controlling the lean operation of an internal combustion engine, especially an internal combustion engine of a motor vehicle, provided with a nitrogen oxide storage catalyst.

In current automotive engineering, spark ignition engines as internal combustion engines with direct gasoline injection instead of conventional intake pipe injection are preferred, since these internal combustion engines compared to conventional spark ignition engines have distinctly more dynamics, are superior with respect to torque and power, and at the same time facilitate a reduction of fuel consumption by up to 15%. This is made possible mainly by so-called stratified charging in the partial load range in which only in the area of the spark plug an ignitable mixture is necessary, while the remaining combustion space is filled with air. As a result, the engine can be operated unchoked; this leads to reduced charge changes. In addition, the direct gasoline injector benefits from reduced heat losses, since the air layers around the mixture cloud are insulated toward the cylinder and the cylinder head. Since conventional internal combustion engines, which work according to the intake manifold principle, can no longer be ignited at such a high air excess as is present in direct gasoline injection, in this stratified charging mode the fuel mixture is concentrated around the spark plug which is positioned centrally in the combustion space, while in the edge areas of the combustion space there is pure air. In order to be able to concentrate the fuel mixture around the central spark plug which is positioned in the combustion space, a concerted air flow in the combustion space is necessary, a so-called tumble flow. In the process, an intense, roller-shaped flow is formed in the combustion space and the fuel is injected only in the last third of the upward motion of the piston. By the combination of a concerted air flow and special geometry of the piston, which for example has for example a pronounced fuel and flow depression, the especially finely dispersed fuel is concentrated in a so-called "mixture ball" ideally around the spark plug and ignites reliably. The engine control provides for the respectively optimized adaptation of the injection parameters (point of injection time, fuel pressure).

These internal combustion engines can therefore be operated in lean operation for a correspondingly long time; this benefits fuel consumption overall, as has been described in the foregoing. This lean operation however entails the disadvantage that the nitrogen oxides (NOx) in lean exhaust cannot be reduced by a 3-way catalyst. In order to keep the nitrogen oxide emissions within the scope of prescribed limits, for example of the Euro-IV limit value, nitrogen oxide storage catalysts are generally used in conjunction with these internal combustion engines. These nitrogen oxide storage catalysts are operated such that the nitrogen oxides produced by the internal combustion engine in a first phase of operation as the lean operating phase are stored in the nitrogen oxide storage catalyst. This first operating phase or lean operating phase of the nitrogen oxide storage catalyst is also called the storage phase. As the length of the storage phase increases, the efficiency of the nitrogen oxide storage catalyst decreases; this leads to an increase of nitrogen oxide emissions downstream of the nitrogen oxide storage catalyst. The reduction in efficiency is caused by the increase in the nitrogen oxide fill level of the nitrogen oxide storage catalyst. The rise in nitrogen oxide emissions downstream of the nitrogen oxide storage catalyst can be monitored and after a definable threshold value is exceeded, a second operating phase of the nitrogen oxide storage catalyst, a so-called discharge phase, can be initiated. During this second operating phase, in the exhaust of the internal combustion engine a reducing agent is added which reduces the stored nitrogen oxides to nitrogen and oxygen. The reducing agent is generally a hydrocarbon (HC) and/or carbon monoxide (CO) which can be produced in the exhaust gas simply by a rich setting of the fuel/air mixture. Towards the end of the discharge phase, most of the stored nitrogen oxide is reduced and less and less of the reducing agent meets the nitrogen oxide which it can reduce to oxygen and nitrogen. Towards the end of the discharge phase the proportion of the reducing agent in the exhaust gas downstream of the nitrogen oxide storage catalyst therefore rises. By corresponding analysis of the exhaust downstream of the nitrogen oxide storage catalyst, for example by means of an oxygen sensor, the end of the discharge phase can then be initiated and it becomes possible to switch again to the lean operation phase. In the disclosed nitrogen oxide storage catalysts this switching is carried out at time intervals of for example 30 to 60 seconds, the regeneration, i.e., the discharge phase, lasting approximately 2 to 4 seconds.

The problem however is that in nitrogen oxide storage catalysts with increasing service life the storage capacity for nitrogen oxides decreases. This is due to the fact that mainly the sulfur contained in fuels leads to poisoning of the storage catalyst, i.e., to permanent deposition of sulfur in the storage catalyst which reduces the storage capacity for nitrogen oxides. The nitrogen oxides are stored in nitrogen oxide storage catalysts in the form of nitrates, while sulfur is stored in the form of sulfates. Since sulfates are chemically more stable than nitrates, the sulfate cannot decompose in nitrogen oxide regeneration. Only at catalyst temperatures above 650° C. under reducing conditions can sulfur be discharged. Such high catalyst temperatures are generally not reached however, especially in city traffic.

The generic WO 02/14658 A1 discloses a process for controlling lean operation of an internal combustion engine having a nitrogen oxide storage catalyst, in which the nitrogen oxides produced by the internal combustion engine in a first operating phase (lean operation) as the storage phase are stored for a specific storage time in the nitrogen oxide storage catalyst, and in which after the storage time expires, by a control device as the engine control at a specific switching instant for a specific discharge time switching to a second operating phase (rich operation) takes place as the discharge phase in which the nitrogen oxides which have been stored during the storage time are discharged from the nitrogen oxide storage catalyst. Furthermore, the nitrogen oxide mass flow upstream of the nitrogen oxide storage catalyst and/or the nitrogen oxide mass flow downstream of the nitrogen oxide storage catalyst are each integrated over the same time interval.

Specifically, here these integral values are put into a relative relationship to one another. Thus, in this process a quality factor will be determined which renders possible a conclusion about the storage capacity of the nitrogen oxide storage catalyst with respect to ageing of the catalyst by sulfur poisoning and thermal damage or the age-induced decrease of the storage capacity. In particular, in this process the degree of poisoning of the catalyst with sulfur will be determined and thus the sulfur content in the control device of the internal combustion engine will be corrected in order to optimize sulfur regeneration. By integration over the time interval, the effects of fluctuations and disruptions on the determined nitrogen oxide mass flow values will be reduced since, viewed over a specific time interval, a type of average value of the quality factor is obtained which will be more conclusive than the individual instantaneous values obtained at specific times. But in practical operation for nitrogen oxide storage catalysts in general such complex operating conditions prevail that the quality factor, in spite of the reference to a specific time interval, under certain circumstances does not adequately reproduce the actual state of the storage capacity of the nitrogen oxide storage catalyst. This can on the one hand have an adverse effect on fuel consumption, since for example a rich mixture is supplied too early. On the other hand, there is the danger that the savings potential by lean operation is so low that only a small advantage in fuel consumption can be gained. Since lean operation however leads to high nitrogen oxide emissions, in certain operating ranges the advantage in fuel consumption is not in a favorable ratio to the actual nitrogen oxide emissions. Discharge itself in this procedure will only take place when the modeled, stored nitrogen oxide mass has exceeded a specific boundary value.

Furthermore, in conjunction with operation of the nitrogen oxide storage catalyst, consideration of ageing, especially the ageing of sulfur poisoning, in the design of a nitrogen oxide storage catalyst is to be taken into consideration in order to ensure that the ageing of the catalyst over the intended service life of the catalyst leads to adherence to given exhaust boundary values with respect to nitrogen oxide emissions in an aged nitrogen oxide storage catalyst. In this respect, adapting the number of discharges to the amount of nitrogen oxide discharged per charging and discharging cycle is generally known such that at a storage capacity of the aged nitrogen oxide storage catalyst which has been reduced relative to a new nitrogen oxide storage catalyst the amount of nitrogen oxide released during the exhaust gas test time interval does not exceed the given exhaust boundary value. This amount of nitrogen oxide which is released per charging cycle for an aged storage catalyst is an absolute quantity and constitutes the absolute nitrogen oxide slip, i.e., that as soon as the storage catalyst is charged with this amount of nitrogen oxide, discharge takes place. This absolute nitrogen oxide slip as an established value applies both to the new and also the aged nitrogen oxide storage catalyst. Since a rich mixture of lambda quantity 1 is required per discharge, with an increasing number of discharges in the course of ageing of a storage catalyst the fuel consumption also rises compared to that of a new storage catalyst.

SUMMARY OF THE INVENTION

The object of the invention is to make available an alternative process for controlling lean operation of an internal combustion engine, especially of a motor vehicle, which has a nitrogen oxide storage catalyst, with which in simplified form an operating mode of the internal combustion engine which is optimized especially with respect to the fuel consumption and with respect to nitrogen oxide emissions is possible.

In a first process step, to establish the instant of switching from the storage phase to the discharge phase, a switching operating point is determined at least from the integral value of the nitrogen oxide mass flow upstream and/or downstream of the storage catalyst. This respective switching operating point is compared in a second process step to a definable operating field which is optimized especially with respect to the fuel savings potential as a function of the load acceptance of the internal combustion engine, which is formed by a plurality of individual operating points for one new and one aged storage catalyst. For a switching operating point which is located within the operating field, the engine control enables lean operation and thus switching between the storage phase and the discharge phase of the nitrogen oxide storage catalyst, while the engine control conversely dictates lambda operation of the internal combustion engine at which lambda is equal to 1 for a switching operating point which departs from the operating field.

Advantageously, with this process, load-dependent determination and control of efficient lean operation are achieved, since in those load ranges in which the savings potential is greatly reduced by lean operation and which cause increased nitrogen oxide emission, the internal combustion engine is operated continuously in lambda operation, i.e., with lambda equal to 1. That is to say that in the instance in which there are hardly any fuel savings, as is the case especially at high load acceptances, such as for example major accelerations, nitrogen oxide emissions can be advantageously greatly reduced by lambda operation. Linkage to the operating field as a function of the load acceptance of the internal combustion engine which is formed by a plurality of individual operating points for a new and an aged storage catalyst results in that here the respective ageing state of the nitrogen oxide storage catalyst is also always taken into consideration, since the savings potential with respect to fuel consumption for a new nitrogen oxide storage catalyst is greater than in an already aged nitrogen oxide storage catalyst; this means that an aged nitrogen oxide storage catalyst at a smaller load acceptance than is the case of a new nitrogen oxide storage catalyst must be switched from lean operation to lambda operation. Since an old nitrogen oxide storage catalyst must be discharged more often than a new nitrogen oxide storage catalyst, i.e., must be switched more often from lean operation to rich operation, this obviously reduces the savings potential with respect to fuel consumption by lean operation. Starting from a definable boundary value discharge must then be effected so often, i.e., switching between lean operation and rich operation must be effected so often, that compared to permanent lambda operation of the internal combustion engine there are hardly any more fuel consumption advantages. This is more critical especially for higher load assumptions than at lower load assumptions, so that by the procedure as claimed in the invention and the comparison of a switching operating point with a load-dependent operating field, simple and reliable determination for control of efficient lean operation becomes possible.

According to an especially preferred process implementation, as claimed in claim 2, the operating field is delimited depending on the load essentially on the one hand by a savings potential boundary curve for a new nitrogen oxide storage catalyst and on the other by the savings potential boundary curve for an aged storage catalyst which represents a boundary ageing state. The savings potential boundary curve for the aged storage catalyst which represents the boundary ageing state can be chosen depending on the individual requirements, i.e., depending on the given savings potential which still enables efficient lean operation with respect to the nitrogen oxide emissions and the fuel consumption advantage. Within the operating field, a change of the switching operating point relative to the previous operating point constitutes a change of the load acceptance and/or is a measure of the change of the savings potential. Migration of the switching operating point at the assumed identical load acceptance in the direction to the aged storage catalyst in the operating field thus represents a measure of the reduction or change of the savings potential.

To establish the switching instant from the storage phase to the discharge phase, a relative nitrogen oxide slip as the difference between the nitrogen oxide mass flow which has flowed into the nitrogen oxide storage catalyst and the nitrogen oxide mass flow which has flowed out of the nitrogen oxide storage catalyst can be determined relative to the storage time, the quotient of the integral values of the nitrogen oxide mass flow upstream and downstream of the nitrogen oxide storage catalyst moreover being brought into a relative relationship with a definable degree of nitrogen oxide conversion which has been derived from the exhaust boundary value, so that when this given switching condition is present in the case of a switching operating point which is within the operating field, switching from the storage phase (lean operation) to the discharge phase (rich operation) is carried out at the switching instant which has been optimized with respect to fuel consumption and the storage potential. Advantageously, as the reference quantity for switching here the focus is thus on the time integrals of the amount of nitrogen oxide which are brought into a relative relationship to one another upstream and downstream of the nitrogen oxide storage catalyst in conjunction with a definable degree of conversion. That is, in this discharge strategy the tail pipe emissions with respect to nitrogen oxide are largely independent of the ageing state of the catalyst and furthermore the exhaust result is also largely independent of the number of discharges per unit of time. With this operating mode, advantageously the storage capacity which is present in the catalyst can be fully used; this is reflected in a new or newer catalyst in fuel consumption which is reduced compared to the aged storage catalyst, since the new or newer catalyst need be discharged less often than an aged catalyst since the relative slip at which discharge is to be carried out is reached only at a later instant than is the case for an aged storage catalyst. For an aged storage catalyst in the operating mode in conjunction with the relative slip, only the number of discharges rises, however their being largely independent of the exhaust result as such. This is due to the fact that with this operating mode discharge would always take place only when this becomes necessary in order not to exceed the given exhaust boundary value per unit of time, since the integrated nitrogen oxide mass flows upstream and downstream of the nitrogen oxide storage catalyst are referenced here to the degree of conversion which is necessary for adherence to the exhaust boundary value. In contrast to the operating mode as in the state of the art, due to the use of the full storage potential a new storage catalyst need be discharged less often viewed over a specific time interval than is the case for a new storage catalyst specified in the state of the art, in which the storage potential of a new storage catalyst cannot be fully used. This is due to the fact that in the operating mode according to the state of the art the absolute nitrogen oxide slip amount which has been defined per discharge as a fixed value applies both to the old and also the new storage catalyst so that the new storage catalyst in the state of the art must always also carry out discharge when this absolute nitrogen oxide slip which is determined beforehand is reached, although the new nitrogen oxide storage catalyst could store still more nitrogen oxides. In contrast, in the approach by the relative relationship the entire instantaneous storage potential is always used, so major fuel savings are achieved that compared to the operating mode in the state of the art especially with regard to a new or newer storage catalyst. This is due to the fact that in the operating mode according to the state of the art, since for a new or newer storage catalyst discharge is initiated earlier than necessary, a rich mixture is also added earlier than necessary.

According to an especially preferred process implementation as claimed in claim 4, it is provided that the relative slip is the quotient of the integral over the nitrogen oxide mass flow downstream of the nitrogen oxide catalyst and of the integral over the nitrogen oxide mass flow upstream of the nitrogen oxide catalyst. This quotient for determining the switching condition is set equal to the definable switching threshold value K which is attributed to the definable degree of nitrogen oxide conversion, so that when this switching condition is met, switching to the discharge phase takes place from the storage phase at the end of the storage time which was determined with it. For example, this switching threshold valve K as claimed in claim 5 satisfies the following equation:

$$K=1-\text{defined rate of nitrogen oxide conversion}$$

The given rate of nitrogen oxide conversion is thus always less than 1, but is preferably at least 0.8, at most preferably however approximately 0.95 with respect to the Euro IV exhaust limit value standard.

According to a further especially preferred process implementation, as claimed in claim 6, to determine the degree of ageing of the storage catalyst from the integral value of the nitrogen oxide mass flow upstream and/or downstream of the storage catalyst and/or the switching instant when the switching condition is met, the switching operating point is furthermore determined as a function of the instantaneous operating temperature at the switching instant. The respective switching operating point is compared in a second stage for determining the degree of ageing of the storage catalyst to a definable storage catalyst capacity field which is optimized especially with respect to fuel consumption, which runs over a temperature window, and which is formed by a plurality of individual operating points for a new and an aged storage catalyst. A switching operating point which lies within the storage catalyst capacity field does not constitute a failure to reach the minimum nitrogen oxide storage capacity, but represents the change relative to the prior operating point as a measure for storage catalyst ageing, while a switching operating point which departs from the storage catalyst capacity field indicates a failure to reach the minimum nitrogen oxide storage capacity.

Advantageously with this process implementation reliable evaluation of the degree of ageing of a nitrogen oxide storage catalyst is thus easily possible, since by additional reference to the instantaneous operating temperature at the switching instant a switching operating point is determined which, compared to the storage catalyst capacity field, makes possible an accurate, reliable conclusion about the respective ageing state of the nitrogen oxide storage catalyst. This is due to the fact that a storage catalyst which is to be regenerated under favorable operating conditions, i.e., especially optimum operating temperatures, can generally make do with a smaller number of discharges than would be the case at operating temperatures which by comparison are unfavorable. This means that due to the small number of discharges in the optimized operating range there is no overly high fuel consumption, as is the case under less favorable operating conditions under which the same storage catalyst must be discharged more often. That is to say, with the procedure as claimed in the invention in those operating states in which optimized operating conditions are present, a conclusion can also be drawn whether the storage catalyst should be regenerated or not. Regeneration is recognized by reference to the operating temperature of the storage catalyst at the correct and thus the optimum instant; this benefits fuel consumption, since operation of the storage catalyst takes place only in the operating range which is desirable with respect to fuel consumption. Advantageously the switching operating point, once determined, on the one hand can thus be used for comparison with the operating field as function of the load acceptance of the internal combustion engine and moreover for comparison with the storage catalyst capacity field in order to derive therefrom the optimum operating mode of the internal combustion engine and/or of the storage catalyst.

Preferably, the storage catalyst capacity field relative to the temperature window is limited on the one hand by the boundary line for a new storage catalyst and on the other hand by the boundary line for an aged storage catalyst which constitutes a boundary ageing state. That is to say, the area of the storage catalyst capacity field which lies between these two boundary curves constitutes a measure of catalyst ageing. The boundary line for an aged storage catalyst which constitutes the boundary ageing stage can be chosen depending on the individual requirements, i.e., for example depending on the given, still tolerable increased fuel consumption in conjunction with an aged storage catalyst and/or a given storage catalyst service life. Especially preferably, the temperature window comprises temperature values between approximately 200° C. and approximately 450° C., for example the optimum operating point being in the range from 280° C. to 320° C.

A process is especially preferable in which, in the event of a failure to reach the minimum nitrogen oxide storage capacity, an error signal is set in the engine control device so that for example the nitrogen oxide storage catalyst can be replaced in order to be able to continue to operate the internal combustion engine with low fuel consumption.

The nitrogen oxide mass flow upstream of the nitrogen oxide storage catalyst is modeled. As a rule however this nitrogen oxide mass flow upstream of the nitrogen oxide storage catalyst could also be measured, for example by means of a nitrogen oxide sensor. This nitrogen oxide sensor is however advantageously provided downstream of the nitrogen oxide storage catalyst in order to measure the nitrogen oxide mass flow downstream of the nitrogen oxide storage catalyst. Especially for the times in which the nitrogen oxide sensor is not ready for operation, the nitrogen oxide mass flow downstream of the nitrogen oxide storage catalyst can also be modeled. Modeling is defined as the raw nitrogen oxide mass flow upstream of the nitrogen oxide storage catalyst and the nitrogen oxide mass flow downstream of the nitrogen oxide storage catalyst being taken from the nitrogen oxide storage model and the raw nitrogen oxide emission model. In the models for example the raw nitrogen oxide mass flow is modeled from the parameters which describe the operating point of the internal combustion engine, for example, the supplied fuel mass or air mass, the torque, etc. Likewise, the modeled nitrogen oxide raw mass flow can however also be taken from a characteristic or family of characteristics.

BRIEF DESCRIPTION OF THE DRAWINGS

The invention will be explained in greater detail with the aid of the drawings.

FIG. 6 shows a schematic of a storage catalyst operating field over a temperature window, FIG. 7 shows a schematic of the amount of nitrogen oxide over time for an operating mode according to the state of the art.

DETAILED DESCRIPTION OF THE INVENTION

FIG. 7 shows a schematic of the amount of nitrogen oxide over time for the operating mode of a nitrogen oxide storage catalyst according to the state of the art. In the left part of the diagram relative to the fixed absolute nitrogen oxide slip the maximum storage time is shown, with solid lines for the new storage catalyst and broken lines for the aged storage catalyst. It is shown purely schematically here that the number of discharges for an aged storage catalyst is higher, so that, since each time a more or less identical amount of nitrogen oxides per unit of time is stored, during a specific time interval for an aged nitrogen oxide catalyst a higher amount of nitrogen oxide is released than is the case during the same time interval for a new storage catalyst. This leads to the fact that here the number of discharges per time interval is directly included in the exhaust result and with reference to adherence to the exhaust boundary values per given exhaust boundary value-unit of time the focus should thus be on the number of possible discharges of an aged storage catalyst at the end of its service life and therefore the fixed absolute slip value must be reduced accordingly to satisfy the exhaust standard. This is schematically shown in the right part of the diagram and thus leads to the storage potential of the new storage catalyst not being used. Since however in this operating mode, based on the fixed absolute slip, for a new storage catalyst the discharge is initiated earlier than actually necessary, this has an adverse effect on fuel consumption in a new storage catalyst since a richer mixture is released earlier than necessary. This means that relative to a specific time interval actually more rich mixture is delivered than would have been necessary during this time interval if the storage capacity of a new or newer storage catalyst which is actually available had been completely used.

Figure 1:
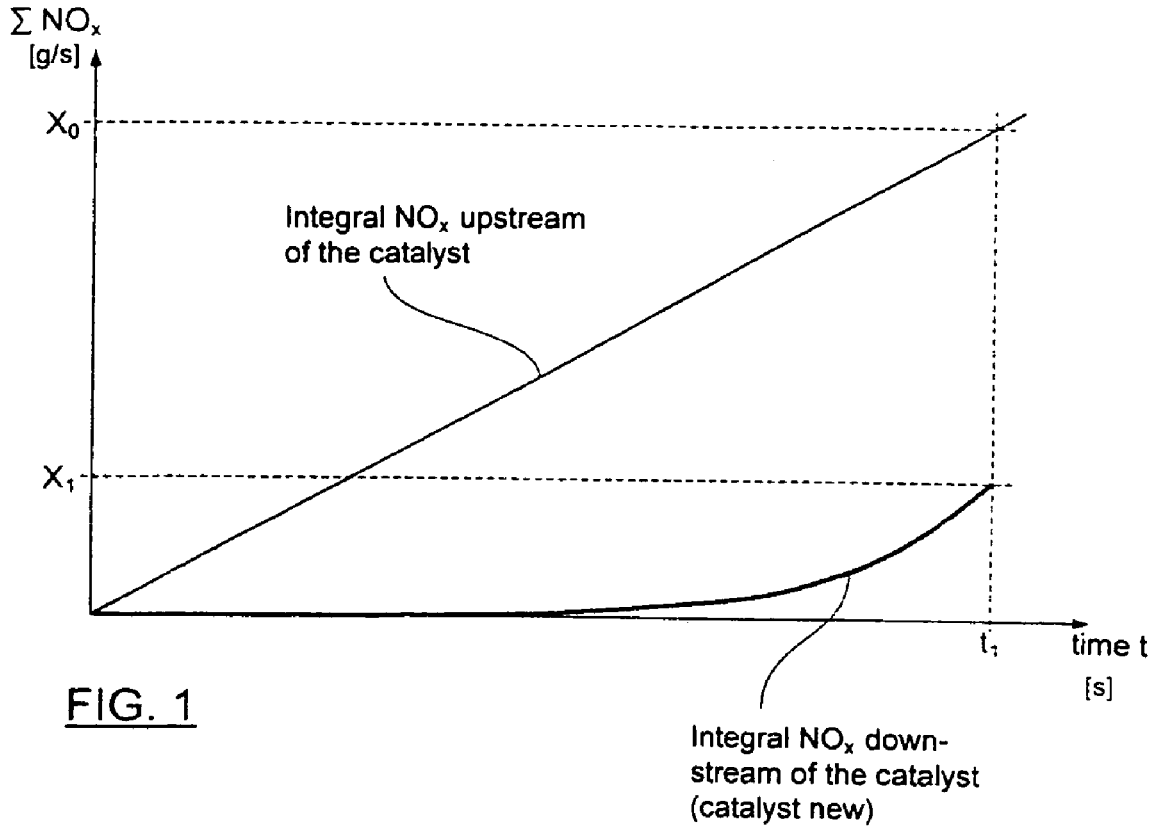
FIG. 1 shows a diagram of the amount of nitrogen oxide over time for a new nitrogen oxide storage catalyst.
Figure 2:
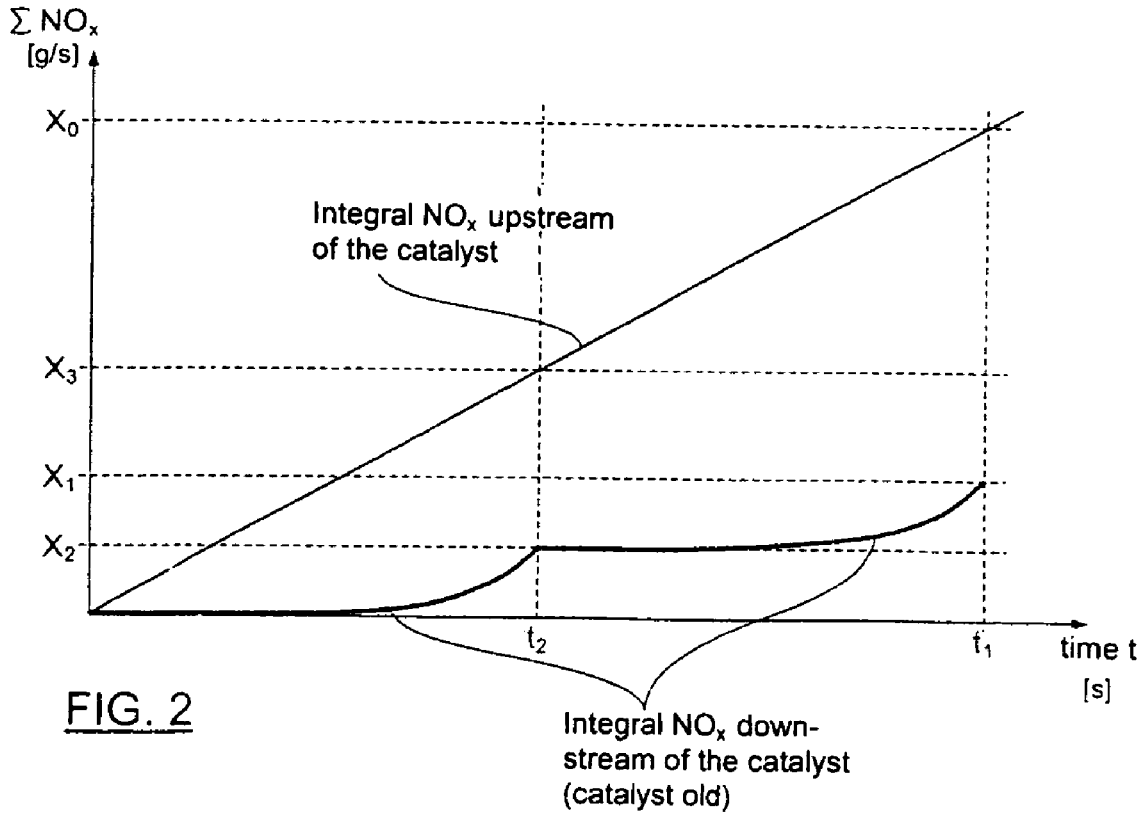
FIG. 2 shows a schematic diagram of the amount of nitrogen oxide over time for an aged nitrogen oxide storage catalyst.

In FIGS. 1 and 2, simply for the sake of illustrating the principle of the specific procedure as claimed in the invention, the amount of nitrogen oxide is plotted schematically and as an example over time, the amount of nitrogen oxide being shown added up. On the basis of constant delivery of a constant amount of nitrogen oxide over time which is assumed solely for simpler illustration, the integral over the nitrogen oxide mass flow upstream of the nitrogen oxide storage catalyst yields a linear rise, as is schematically shown in FIGS. 1 and 2 over the time interval under consideration. For a new nitrogen oxide storage catalyst the full storage capacity is still present, i.e., for example sulfur poisoning has not yet taken place, so that for a storage time $t_1$ nitrogen oxides are stored in the nitrogen oxide storage catalyst until the quotient of the integral over the nitrogen oxide mass flow downstream of the nitrogen oxide catalyst and of the integral over the nitrogen oxide mass flow upstream of the nitrogen oxide catalyst is equal to a given switching threshold value K which is derived from the exhaust boundary value and which originates from a given degree of nitrogen oxide conversion which is derived from the exhaust boundary value, so that when this switching condition is satisfied, after expiration of the storage time $t_1$ switching takes place to a discharge phase which is no longer shown here and in which a rich mixture is supplied for discharging the nitrogen oxides. For example, the switching threshold valve K at a given rate of nitrogen oxide conversion of 95%, i.e., of 0.95, is then 0.05 relative to 1 (=100%) as the reference quantity. This means that in the present case of a new nitrogen oxide storage catalyst the discharge phase is initiated when the quotient of the two aforementioned integrals is equal to 0.05 or 5%.

FIG. 2 shows essentially the same for an aged nitrogen oxide storage catalyst, i.e., for a nitrogen oxide storage catalyst which for example has already been highly poisoned by sulfur. As becomes apparent from the sample representation of FIG. 2 which is only schematic, only two discharges are necessary in such an aged nitrogen oxide storage catalyst within the same time interval $t_1$ under consideration for example, once after time $t_2$ which is prior to time $t_1$, and then in turn at time $t_1$ which corresponds to time $t_1$ of FIG. 1. The relative slip as the quotients from the integral over the nitrogen oxide mass flow downstream and upstream of the nitrogen oxide storage catalyst and relating it to a stipulated degree of nitrogen oxide conversion which can be derived from the exhaust boundary value result in that at the switching instant at which the switching condition is satisfied, the quotient of the integral values $X_2$ and $X_3$ at time $t_2$ and the quotient of the integral values $X_1$ and $X_0$ at time $t_1$ and also the quotient of the difference of the integral values $X_1$-$X_2$ and $X_0$-$X_3$ at time $t_1$ is always equal to the given switching threshold value K. Likewise, the quotient of the integral values $X_1$ and $X_0$ at time $t_1$ (switching instant) corresponds to FIG. 1, i.e., for a practically new nitrogen oxide storage catalyst to this switching threshold value K so that by reference as claimed in the invention to the degree of nitrogen oxide conversion it is always ensured that a discharge takes place when this is necessary to satisfy the degree of conversion which originates from a specific exhaust boundary value. That is to say, the storage capacity which is present in the nitrogen oxide storage catalyst can be fully used according to the ageing state of the nitrogen oxide storage catalyst.

Figure 3:
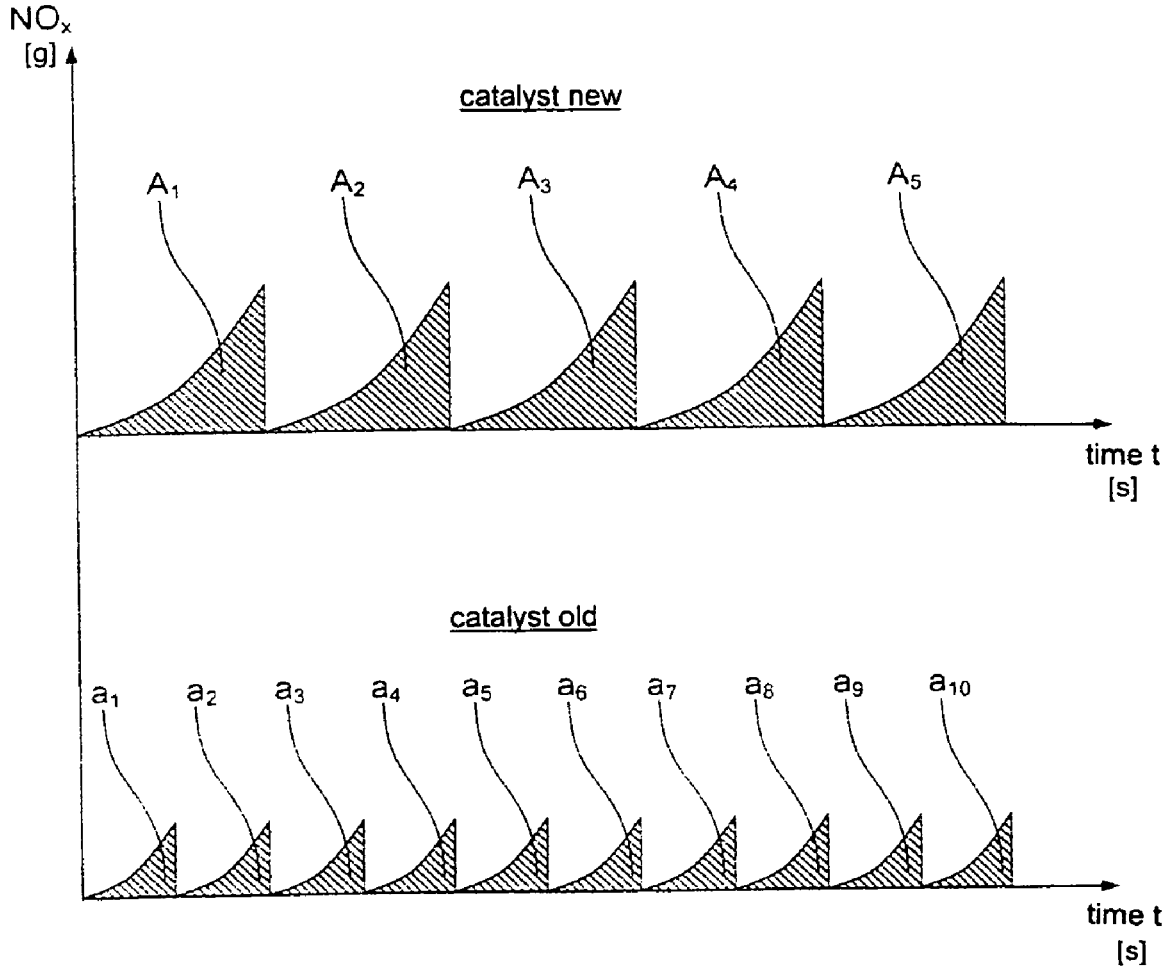
FIG. 3 shows a comparative schematic of the discharge cycles of a new and aged nitrogen oxide storage catalyst.

As shown especially in FIG. 3, this procedure further results in the exhaust boundary value always being maintained since the number of discharges rises as the ageing of the catalyst increases, but this has no effect at all on the amounts of exhaust as such, since the number of discharges at each instant of ageing is adapted optimally to the required conversion rate and thus the stipulated exhaust boundary value such that this exhaust boundary value and thus the required conversion rate per exhaust boundary value-time interval are not exceeded. Thus the amount of exhaust which is shown crosshatched in FIG. 3 on the upper x-axis and which is released per discharge process as a sum corresponds to the amounts of exhaust $A_1$, $A_2$, $A_3$, $A_4$, and $A_5$, here for the special case of a constant operating point of the internal combustion engine is $A_1=A_2=A_3=A_4=A_5$, exactly the amount of exhaust shown on the lower x-axis as the sum of areas $a_1$ to $a_{10}$, here for the special case of a constant operating point of the internal combustion engine $a_1=a_2=a_3= \ldots =a_{10}$. Moreover, here the sum of the area integrals of post catalyst emissions for a new and for an aged storage catalyst is almost the same.

That is to say that, viewed over the same time interval for an aged nitrogen oxide storage catalyst, only the number of discharges rises, but not the amount of nitrogen oxide released during this time interval, so that a stipulated emission boundary value as the exhaust value can thus always be maintained.

Figure 4:
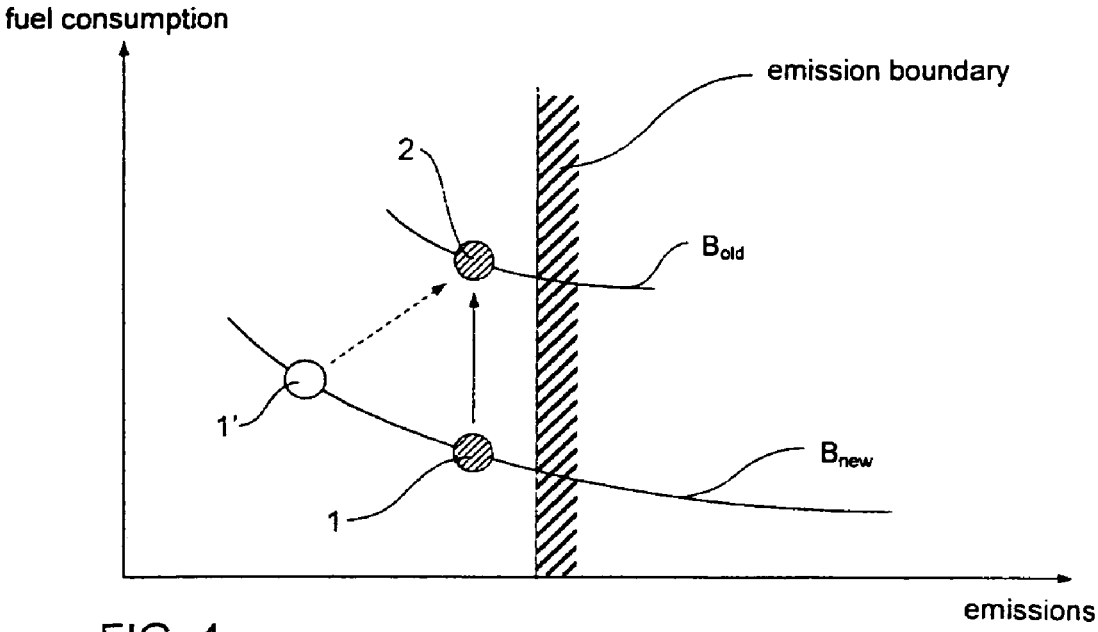
FIG. 4 shows a schematic of the consumption over emissions with application lines for a new and an aged nitrogen oxide storage catalyst in comparison.

The advantage of this process implementation is also apparent in the diagram of fuel consumption over emissions shown in FIG. 4. This diagram on the one hand shows the operating line as the application line $B_{new}$ for a new nitrogen oxide storage catalyst and the operating line as the application line $B_{old}$ for an aged nitrogen oxide storage catalyst. This diagram shows that the nitrogen oxide storage catalyst, as is shown in FIG. 4 by reference number 1, is possible with low consumption without allowance for catalyst ageing, as is the case in process implementation according to the state of the art and as shown in FIG. 4 by 1' and by the broken line, so that in the course of catalyst ageing due to the increased number of discharges the fuel consumption does rise, but the emission limit is not exceeded. In contrast to the operating mode according to the state of the art, in the operating mode as claimed in the invention the exhaust result for a new storage catalyst is "poorer", but permanently below the prescribed exhaust boundary value. This means that with this operating mode an always optimized operating mode is possible without the occurrence of unnecessary holding in readiness at the new storage catalyst.

Figure 5:
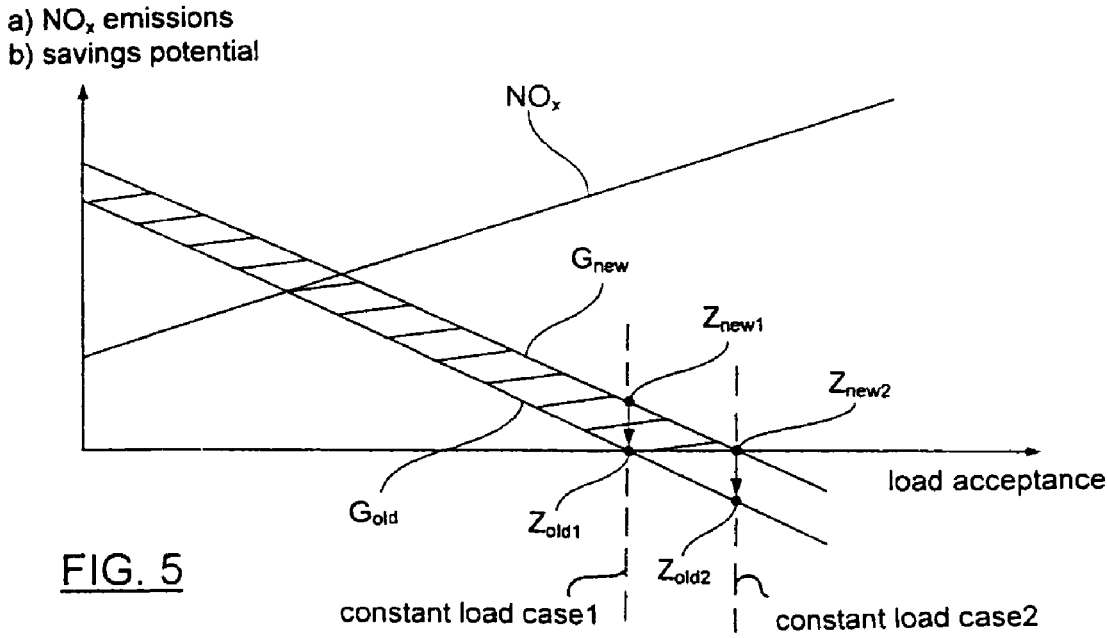
FIG. 5 shows a schematic of the operating field optimized with respect to fuel savings potential as a function of the load acceptance.

FIG. 5 shows an operating field which has been optimized with respect to the fuel savings potential as a function of the load acceptance of the internal combustion engine, the x-axis plotting the load acceptance, while the y-axis plots the nitrogen oxide emissions here, i.e., especially the raw nitrogen oxide emissions. The NOx curve shows that with increasing load acceptance the raw nitrogen oxide emissions rise. Furthermore the savings potential is also schematically plotted on the y-axis. The savings potential over the load acceptance spans the load-dependent operating field which on the one hand is limited by the savings potential boundary curve $G_{new}$ of a new nitrogen oxide storage catalyst and on the other hand by the savings potential boundary curve $G_{old}$ for an aged storage catalyst which represents the boundary ageing state. As a comparison of these two boundary curves $G_{new}$ and $G_{old}$ shows, the savings potential with respect to fuel consumption for a new storage catalyst is greater than for an old or aged storage catalyst. This operating field which is optimized with respect to fuel savings potential as a function of the load acceptance of the internal combustion engine is thus formed by a plurality of individual operating points for a new and an aged storage catalyst.

For determination and/or control of efficient lean operation as claimed in the invention, in a first process step the relative nitrogen oxide slip, as has already been described in detail, is determined as the switching condition so that when this stipulated switching condition is present, switching from the storage phase to the discharge phase, i.e., from lean operation to rich operation could be carried out at the switching instant which is optimized with respect to fuel consumption and storage potential.

This switching operating point which has been determined in this way is compared to the load-depending operating field in a second process step. This load-dependent operating field is shown in FIG. 5 and is spanned by the savings potential boundary curve $G_{new}$ for a new nitrogen oxide storage catalyst and for the savings potential boundary curve $G_{old}$ for a old nitrogen oxide storage catalyst. The X-axis of the diagram shown only schematically as an example in FIG. 5 plots the load acceptance. The part of the operating field above the load acceptance x-axis is crosshatched and represents a so-called positive fuel savings potential, while the part of the operating field which is no longer crosshatched underneath the load acceptance x-axis already represents a negative fuel savings potential, i.e., increased fuel consumption. Moreover, in the diagram of FIG. 5 the rise in NOx emissions, i.e., especially raw NOx emissions as load acceptance rises, is also shown. If for example a constant load case 1 is examined which in the diagram of FIG. 5 is characterized essentially by the intersection points with the savings potential boundary curves $G_{new}$ and $G_{old}$ as the switching operating points $Z_{new1}$ and $Z_{old1}$, it becomes apparent therefrom that the fuel savings potential for a new storage catalyst is much greater than for an old or aged storage catalyst. This means that for a new storage catalyst efficient lean operation is also possible at higher load acceptances than in an aged storage catalyst. As a comparison of the two operating points $Z_{old1}$ and $Z_{new2}$ shows, the same boundary state for efficient lean operation in a new storage catalyst is reached at much higher load acceptance than is the case for an old or aged storage catalyst.

When examining the constant load case 2 in FIG. 5, the storage catalyst ageing from $Z_{new2}$ in the direction of $Z_{old2}$ represents a deterioration of the savings potential, such that efficient lean operation is no longer possible and engine control here for this load acceptance dictates lambda operation of the internal combustion engine, in which lambda is equal to 1.

FIG. 6 moreover shows a storage catalyst capacity field over a temperature window, here the x-axis plotting the temperature in ° C. and the y-axis here plotting the integral value of the nitrogen oxide mass flow upstream of the storage catalyst. This means that the storage catalyst capacity field shown here is shown relative to the integral values of the nitrogen oxide mass flow upstream of the storage catalyst. But alternatively a storage catalyst capacity field could fundamentally also be shown here which is referenced to the integral values downstream of the nitrogen oxide storage catalyst and/or to time. The reference to the integral values upstream of the nitrogen oxide mass flow is however preferred in this instance, since this makes possible a more reliable conclusion about the ageing state of the storage catalyst, in contrast to the integral values downstream of the storage catalyst which are dependent on other factors and to the time which is likewise dependent on other factors. As FIG. 6 shows, the storage catalyst capacity field relative to the temperature window is bordered on the one hand by a stipulated boundary line $B_{new}$ for a new storage catalyst and on the other hand by a definable boundary line $B_{old}$ for an aged storage catalyst which represents a boundary ageing state. The crosshatched capacity field area which lies in between is a measure of catalyst ageing. The storage catalyst capacity field is stipulated optimized with respect to fuel consumption and is spanned by a plurality of individual operating points which are determined for example by measurement technology for a new and a more or less aged storage catalyst.

In the case shown in FIG. 6, an integral value X of the nitrogen oxide mass flow upstream of the storage catalyst when the switching condition is satisfied is linked to the instantaneous operating temperature at the switching instant which here is for example 320° C. In the diagram of FIG. 6, a switching operating point U is thus determined which in the example shown in FIG. 6 lies in the storage catalyst capacity field. This switching operating point which lies within the storage catalyst capacity field does not represent a failure to reach the minimum nitrogen oxide storage capacity, so that for example an i. O-signal is relayed to the control device. The change relative to a preceding operating point proceeding from the operating point $U_{new}$ of a new nitrogen oxide storage catalyst represents a measure of the storage catalyst ageing, as is shown schematically in FIG. 6 by the arrow 1. That is, the integral value of the nitrogen oxide mass flow upstream of the storage catalyst during regeneration is always relearned. If a change in the direction of arrow 1 has taken place such that the operating point is underneath the boundary operating point $U_{old}$, a failure to reach the minimum nitrogen oxide storage capacity is recognized and an error signal in the engine control device is set.

FIG. 6 thus shows here that for each operating state of the nitrogen oxide storage catalyst, depending on the operating temperature a conclusion can be drawn regarding the exact ageing state of the nitrogen oxide storage catalyst. Since the lower aged storage catalyst boundary line which represents the boundary ageing state in terms of location can be matched to a stipulated fuel consumption in conjunction with discharges, storage catalyst ageing which can no longer be tolerated therefore can be displayed at a time at which the fuel consumption is still being kept within a stipulated tolerance framework.

A combination of all these measures therefore results in an especially advantageous operating option for an internal combustion engine, especially with respect to fuel consumption and/or efficient lean operation.

The invention claimed is:

1. A process for controlling the lean operation of an internal combustion engine, provided with a nitrogen oxide storage catalyst, the process comprising:

performing a first operating phase (lean operation), comprising storing, as a storage phase, nitrogen oxides produced by the internal combustion engine for a specific storage time in the nitrogen oxide storage catalyst, switching to a second operating phase (rich operation) after the storage time expires, by a control device as the engine control at a specific switching instant for a specific discharge time as the discharge phase in which the nitrogen oxides which have been stored during the storage time are discharged from the nitrogen oxide storage catalyst, flowing the nitrogen oxide mass upstream of the nitrogen oxide storage catalyst and/or downstream of the nitrogen oxide storage catalyst each being integrated over the same time interval, determining a switching operating point in a first process step, to establish the instant of switching from the storage phase to the discharge phase, at least from the integral value of the nitrogen oxide mass flow upstream and/or downstream of the storage catalyst, and comparing the respective switching operating point in a second process step to a definable operating field which is optimized-with respect to a fuel savings potential as a function of a load acceptance of the internal combustion engine, which is formed by a plurality of individual operating points for one new and one aged storage catalyst;

determining a relative nitrogen oxide slip as the difference between the nitrogen oxide mass flow which has flowed into the nitrogen oxide storage catalyst and the nitrogen oxide mass flow which has flowed out of the nitrogen oxide storage catalyst to establish the switching instant from the storage phase to the discharge phase relative to the storage time, and bringing the quotient of the integral values of the nitrogen oxide mass flow upstream and downstream of the nitrogen oxide storage catalyst into a relative relationship with a definable degree of nitrogen oxide conversion which has been derived from the exhaust boundary value, so that when these given switching conditions are present in the case of a switching operating point which is within the operating field, switching from the storage phase (lean operation) to the discharge phase (rich operation) is carried out at the switching instant which has been optimized with respect to fuel consumption and the storage potential, whereby when a switching operating point is located within an operating field, the engine control enables lean operation and thus switching between the storage phase and the discharge phase of the nitrogen oxide storage catalyst, while the engine control conversely dictates lambda operation of the internal combustion engine at which lambda is equal to 1 for a switching operating point which departs from a definable operating field.

2. The process as claimed in claim 1, further comprising spanning the operating field depending on the load by a savings potential boundary curve for a new nitrogen oxide storage catalyst and by a savings potential boundary curve for an aged storage catalyst which represents a boundary ageing state.

3. The process as claimed in claim 1, wherein:

the relative slip is the quotient of the integral over the nitrogen oxide mass flow downstream of the nitrogen oxide catalyst and of the integral over the nitrogen oxide mass flow upstream of the nitrogen oxide catalyst and wherein this quotient for determining the switching condition is set equal to the definable switching threshold value K which originates from the definable degree of nitrogen oxide conversion so that when this switching condition is met, switching to the discharge phase takes place from the storage phase at the end of the storage time which was thus determined.

4. The process as claimed in claim 3, wherein the switching threshold valve K satisfies the following equation:

$$K=1-\text{defined rate of nitrogen oxide conversion}$$

with a given rate of nitrogen oxide conversion of less than 1, preferably with a given rate of nitrogen oxide conversion of at least 0.80, at most preferably of 0.95.

5. The process as claimed in claim 1, wherein the switching operating point is determined as a function of the instantaneous operating temperature at the switching instant to determine the degree of ageing of the storage catalyst from the integral value of the nitrogen oxide mass flow upstream and/or downstream of the storage catalyst and/or the switching instant when the switching condition is met, and further comprising comparing the respective switching operating point in a second stage for determining the degree of ageing of the storage catalyst to a definable storage catalyst capacity field which is optimized with respect to fuel consumption, which runs over a temperature window, and which is formed by a plurality of individual operating points for a new and an aged storage catalyst, such that the switching operating point which lies within the storage catalyst capacity field does not constitute a failure to reach the minimum nitrogen oxide storage capacity, but represents the change relative to the prior operating point as a measure of storage catalyst ageing, and wherein a switching operating point which departs from the storage catalyst capacity field indicates a failure to reach the minimum nitrogen oxide storage capacity.

6. The process as claimed in claim 5, wherein the storage catalyst capacity field relative to the temperature window is limited by the boundary line for a new storage catalyst and by the boundary line for an aged storage catalyst which constitutes a boundary ageing state.

7. The process as claimed in claim 5, wherein the temperature window comprises temperature values between approximately 200° C. and approximately 450° C.

8. The process as claimed in claim 5 further comprising setting an error signal in the engine control device in the event of a failure to reach the minimum nitrogen oxide storage capacity.

9. The process as claimed in claim 1, wherein the nitrogen oxide mass flow is modeled upstream of the nitrogen oxide storage catalyst.

10. The process as claimed in claim 1 further comprising measuring the nitrogen oxide mass flow downstream of the nitrogen oxide storage catalyst by means of an nitrogen oxide sensor.

* * * * *